US007918254B2

(12) United States Patent
Langer

(10) Patent No.: US 7,918,254 B2
(45) Date of Patent: Apr. 5, 2011

(54) METHOD AND APPARATUS FOR CREATING DESIGNS ON SURFACES

(76) Inventor: Deborah Langer, Staten Island, NY (US)

( * ) Notice: Subject to any disclaimer, the term of this patent is extended or adjusted under 35 U.S.C. 154(b) by 818 days.

(21) Appl. No.: 11/535,209

(22) Filed: Sep. 26, 2006

(65) Prior Publication Data

US 2007/0079903 A1 Apr. 12, 2007

Related U.S. Application Data

(60) Provisional application No. 60/721,190, filed on Sep. 28, 2005.

(51) Int. Cl.
*B27M 3/00* (2006.01)

(52) U.S. Cl. ..... 144/372; 144/359

(58) Field of Classification Search ..... 144/329, 144/359, 364, 380, 358, 360; 984/210, 211; 427/261; D17/14; 33/562, 563, 566, 666
See application file for complete search history.

(56) References Cited

U.S. PATENT DOCUMENTS

| | | | | | |
|---|---|---|---|---|---|
| 1,869,839 | A | * | 8/1932 | Boulard | 156/62 |
| 2,300,698 | A | * | 11/1942 | Pentz | 409/122 |
| 2,392,560 | A | * | 1/1946 | Vitoux | 173/200 |
| 2,652,267 | A | * | 9/1953 | Endlich | 462/69 |
| 3,633,286 | A | * | 1/1972 | Maurer | 434/87 |
| 3,927,599 | A | * | 12/1975 | Raymond | 409/90 |
| 3,946,491 | A | * | 3/1976 | Bailey et al. | 33/23.01 |
| 4,297,060 | A | * | 10/1981 | Ross | 409/86 |
| 4,397,342 | A | * | 8/1983 | North | 144/48.6 |
| D276,352 | S | * | 11/1984 | Kaman | D17/14 |
| 4,670,991 | A | * | 6/1987 | McKay et al. | 33/564 |
| 5,226,990 | A | * | 7/1993 | Satomi | 156/62 |
| 5,282,047 | A | * | 1/1994 | Suzuki | 409/85 |
| 5,484,495 | A | * | 1/1996 | Moore | 156/62 |
| 5,493,965 | A | * | 2/1996 | Lizarazu | 101/3.1 |
| 6,135,350 | A | * | 10/2000 | White et al. | 235/380 |
| 6,824,337 | B2 | * | 11/2004 | Pentz et al. | 409/132 |
| 6,829,990 | B2 | * | 12/2004 | Cochran et al. | 101/127.1 |
| 7,093,368 | B1 | * | 8/2006 | Nelson | 33/18.1 |
| 7,111,656 | B2 | * | 9/2006 | Cureton | 144/364 |
| 7,121,196 | B2 | * | 10/2006 | Mellis | 101/32 |
| 2005/0103182 | A1 | * | 5/2005 | Spurgeon | 84/291 |

FOREIGN PATENT DOCUMENTS

WO WO 9957709 A1 * 11/1999

* cited by examiner

*Primary Examiner* — Dana Ross
*Assistant Examiner* — Jennifer Chiang
(74) *Attorney, Agent, or Firm* — Ostrolenk Faber LLP

(57) ABSTRACT

A method for creating a design on a surface comprising providing a template to overlay the surface upon which the design is to be created, forming a pattern of the design on the template for the design which is to be created on the surface, placing the template with the pattern of the design thereon on the surface, with a tool, tracing the pattern of the design on the template to form an impression on the surface below the template and removing the template leaving the impression of the design on the surface.

12 Claims, 6 Drawing Sheets

METHOD AND APPARATUS FOR CREATING DESIGNS ON SURFACES

CROSS-REFERENCE TO RELATED APPLICATIONS

The present application claims the benefit and priority of U.S. Provisional Application Ser. No. 60/721,190 filed Sep. 28, 2005 entitled METHOD AND APPARATUS FOR CREATING DESIGNS ON SURFACES, the entire disclosure of which is hereby incorporated by reference herein.

BACKGROUND OF THE INVENTION

The present invention relates to methods for creating designs, for example artistic designs on surfaces, and in particular, for creating such designs on wood and other surfaces. In particular, the present invention can be used to create designs on the surfaces of musical instruments made from wood, for example, guitars.

SUMMARY OF THE INVENTION

According to the invention, a method is provided for creating designs on surfaces. The method comprises providing a template to overlay the surface upon which the design is to be created; forming a pattern of the design on the template for the design which is to be created on the surface; placing the template with the pattern of the design thereon on the surface; with a tool, tracing the pattern of the design on the template to form an impression of the design on the surface below the template; and removing the template leaving the impression of the design on the surface.

The invention provides a new form of artistic expression and is particularly adapted to forming designs on such wooden surfaces as guitars or the blanks for guitars. However, the invention can be applied to surfaces other than wood and to wood surfaces other than musical instruments.

Other features and advantages of the present invention will become apparent from the following detailed description.

BRIEF DESCRIPTION OF THE DRAWING(S)

The invention will be described in greater detail in the following detailed description in which.

DETAILED DESCRIPTION OF PREFERRED EMBODIMENTS OF THE INVENTION

With reference now to the drawings, the invention comprises a method for forming designs on surfaces, for example, wood surfaces, although the invention is not limited to forming designs on wood.

Further, the invention can be applied to form designs on wood that has been finished with a finishing material such as lacquer, varnish or polyurethane, for example, or it can be applied to untreated wood.

Figure 1:
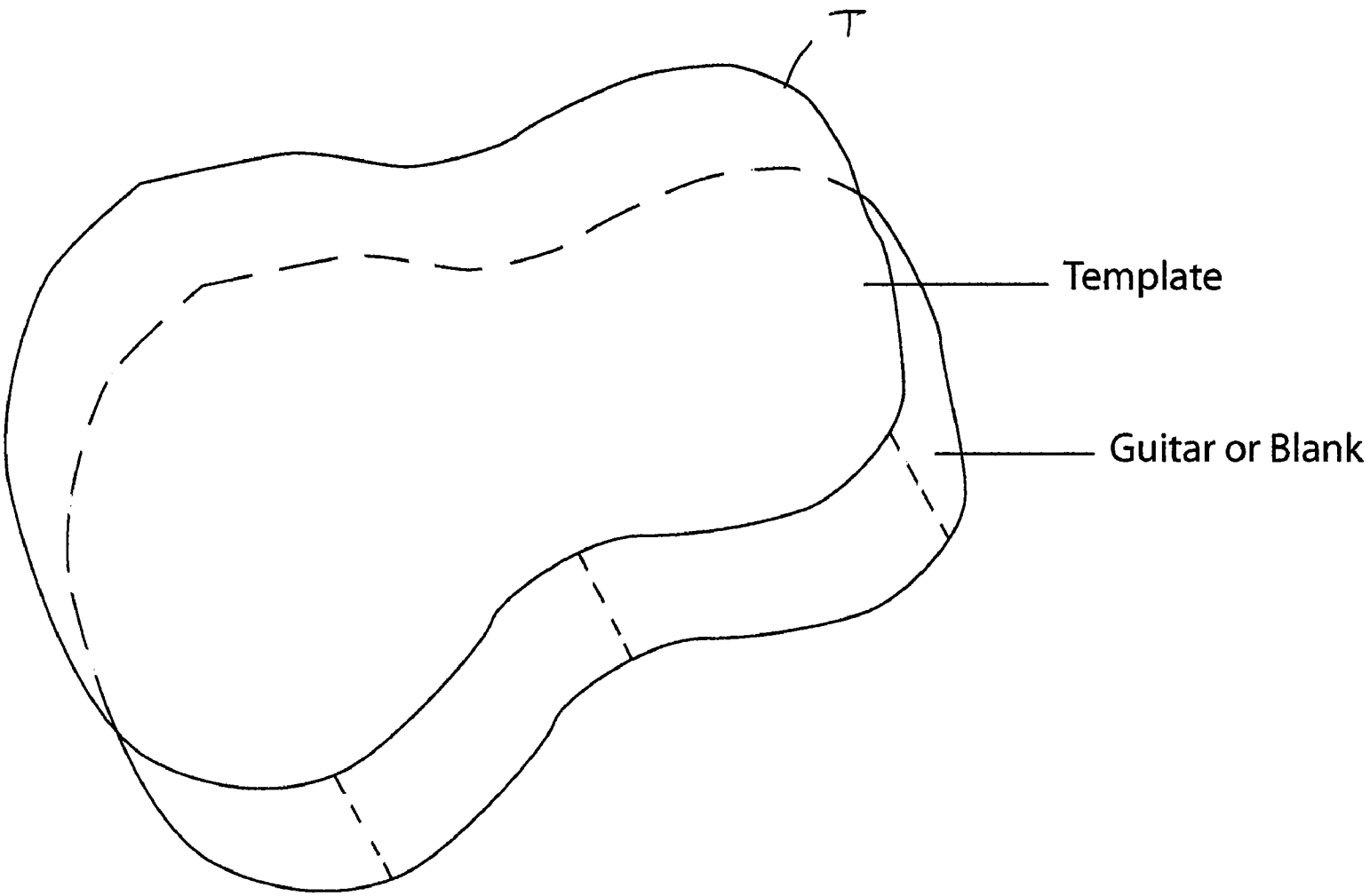
FIG. 1 shows a template for a guitar or guitar blank.
Figure 2A:
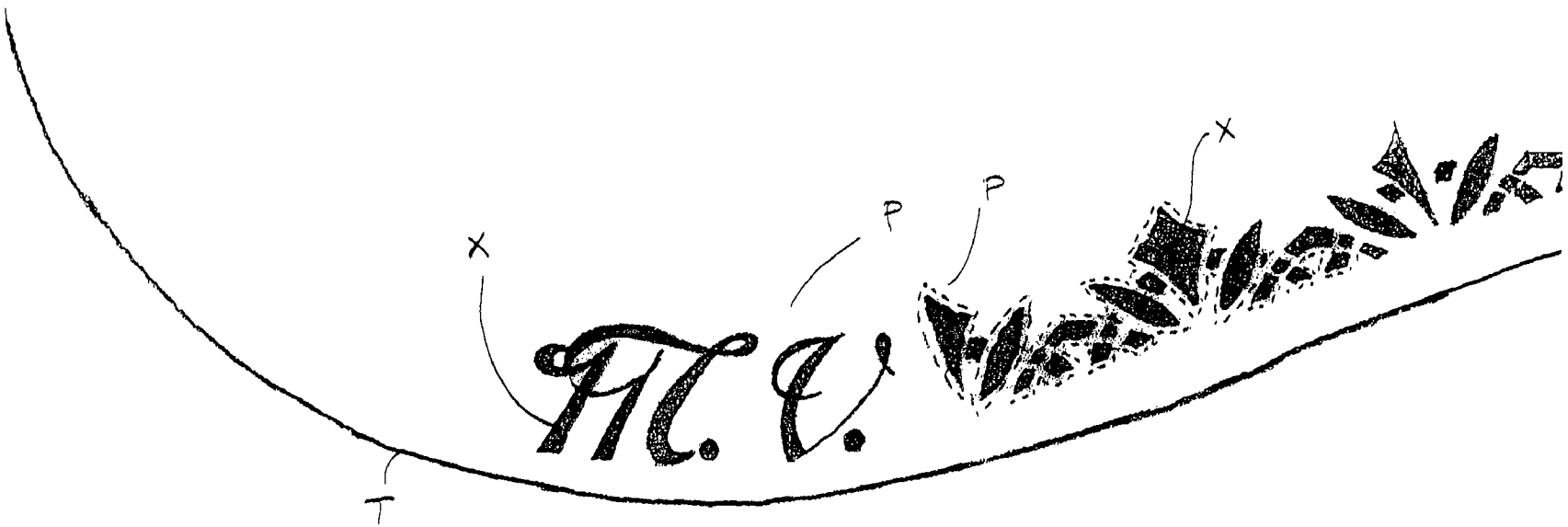
FIGS. 2A and 2B show examples of portions of a template with a pattern of a design traced out thereon.
Figure 2B:
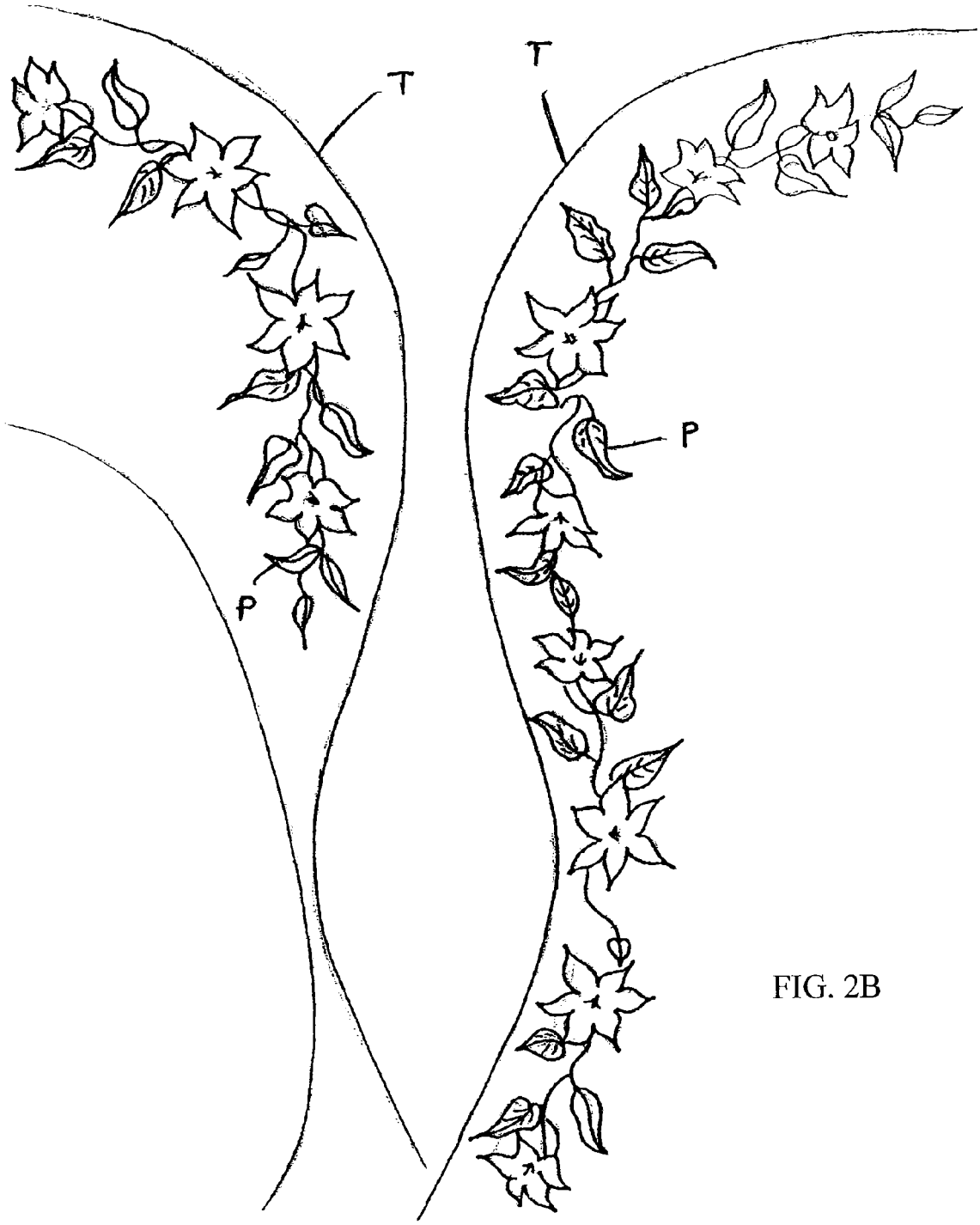
Figure 3:
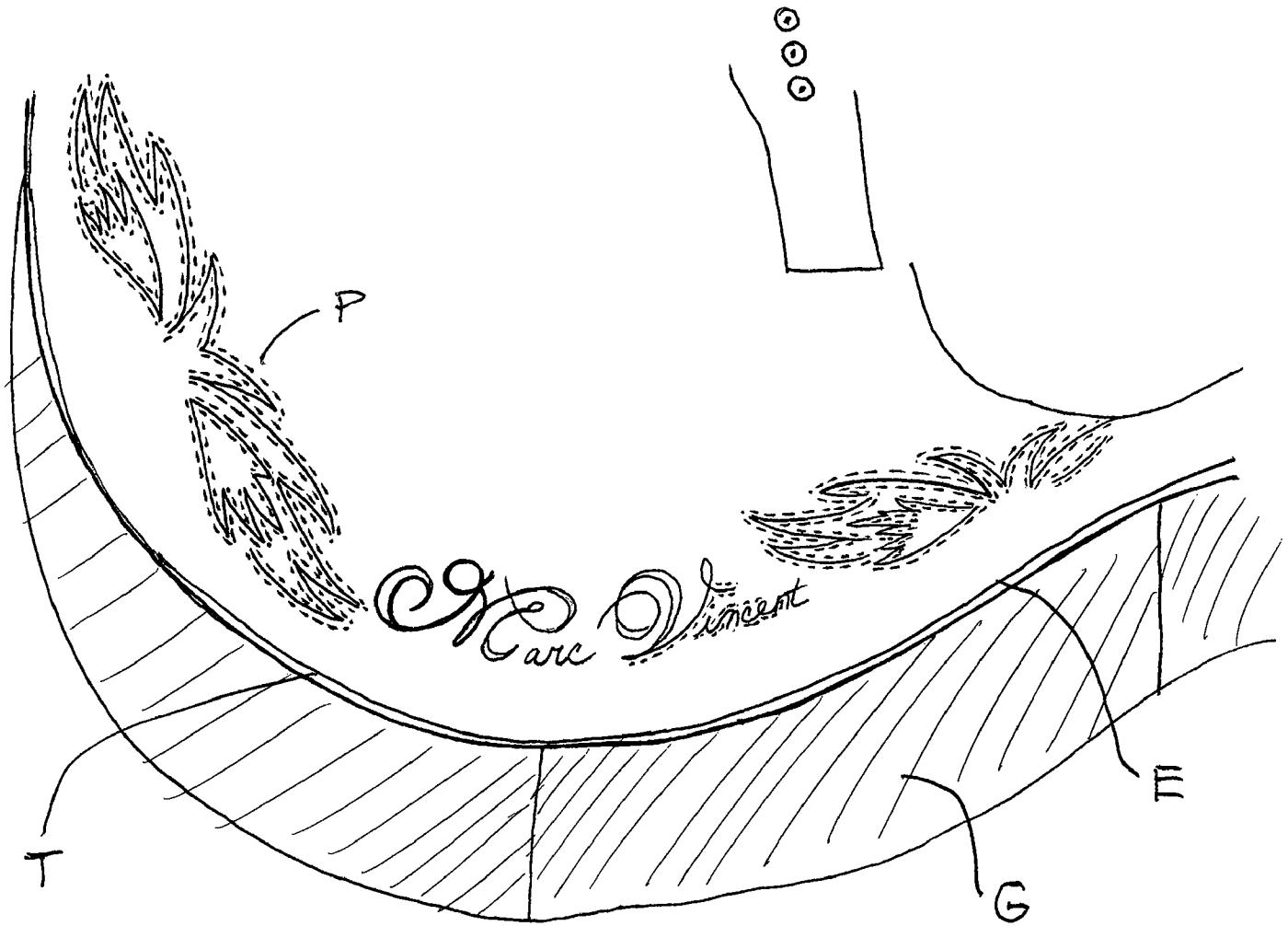
FIG. 3 shows a template with a pattern thereon on a guitar.

First, according to the invention, an overlay or template T, for example, formed from vellum or some other suitable material, is overlaid over the surface, for example as shown in FIG. 1, the surface of a guitar or guitar blank (top or other piece of a guitar which has not yet been assembled into the finished instrument). The surface can be any surface of the item to be decorated, for example a guitar top, side or bottom. The template T is cut to the size of the surface and then the pattern of the design is drawn or traced on the template using any artist's medium, e.g., pencil, pen, paint, marker, etc. FIGS. 2A and 2B show examples of portions of cutout templates T after a design pattern P has been traced thereon. The template with the pattern P thereon is then taped to the surface on which the design is to be created. FIG. 3 shows the template T with a pattern thereon on a guitar G surface. The tape holding it on is not shown, but may be placed along the edges E so as not to cover the pattern. Masking tape may be used. It will be appreciated that any means of temporary securement can also be used.

Once the template T is temporarily attached to the surface, for example with tape, a tool with a needle-like point and a sturdy handle is used to create an impression in the surface by following the design pattern made on the template. The point is used to perforate the template and create an impression in the surface below, for example, a wood surface. The purpose of using the template is to obtain greater accuracy in the creation of the actual design on the surface and so that the way the design will appear on the surface can be observed before actually making any impressions in the surface. If continuous or solid lines or areas are to be formed, the impressions created by the point of the needle are made at very closely spaced intervals so that they will appear continuous or solid. For example, FIG. 2A shows portions X which appear essentially continuous but such portions in the finished artwork are made by closely spaced needle marks so that the design appears continuous or solid in these portions.

Figure 4:
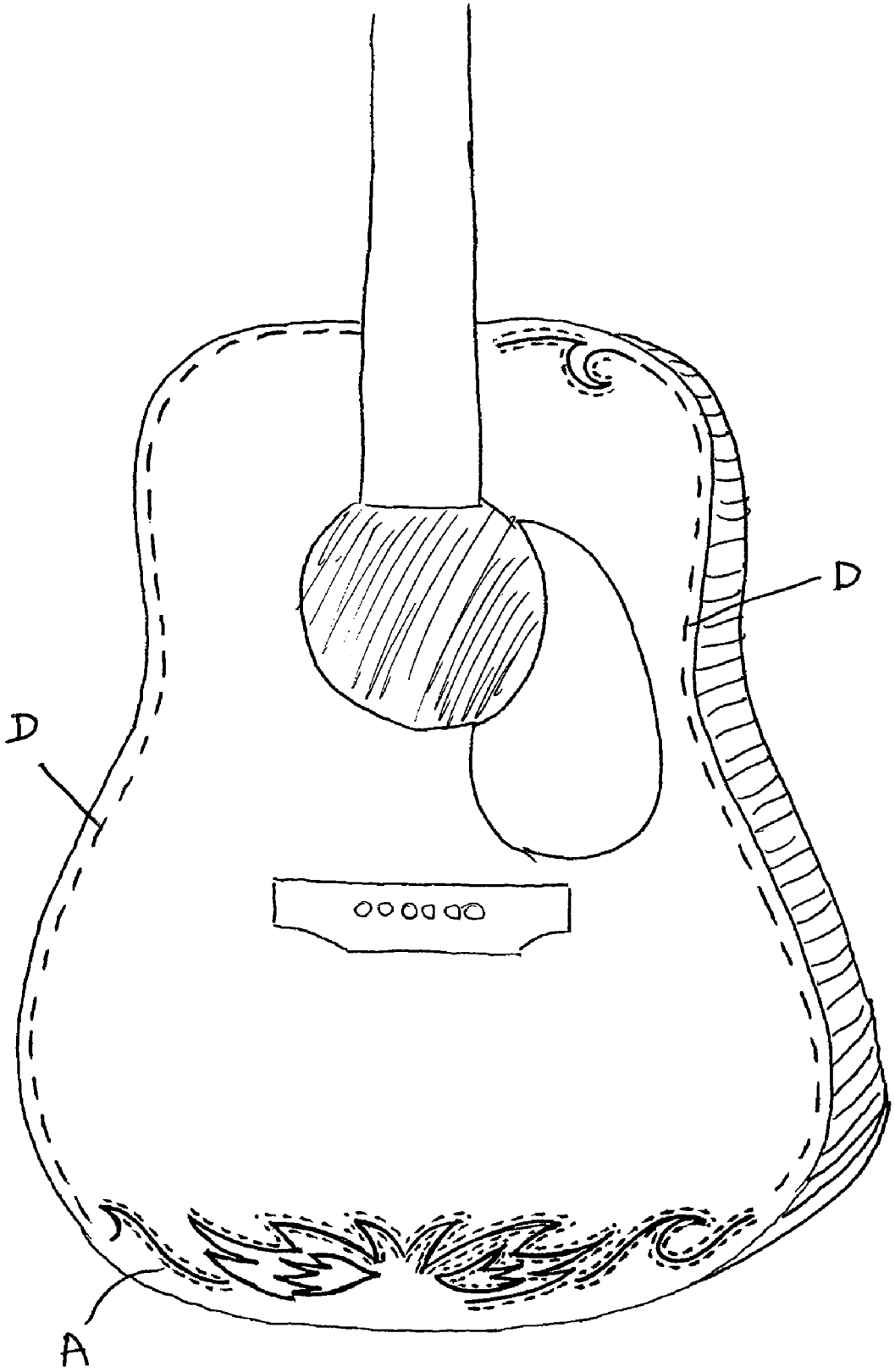
FIG. 4 shows an example of a finished art work design on a guitar.
Figure 5:
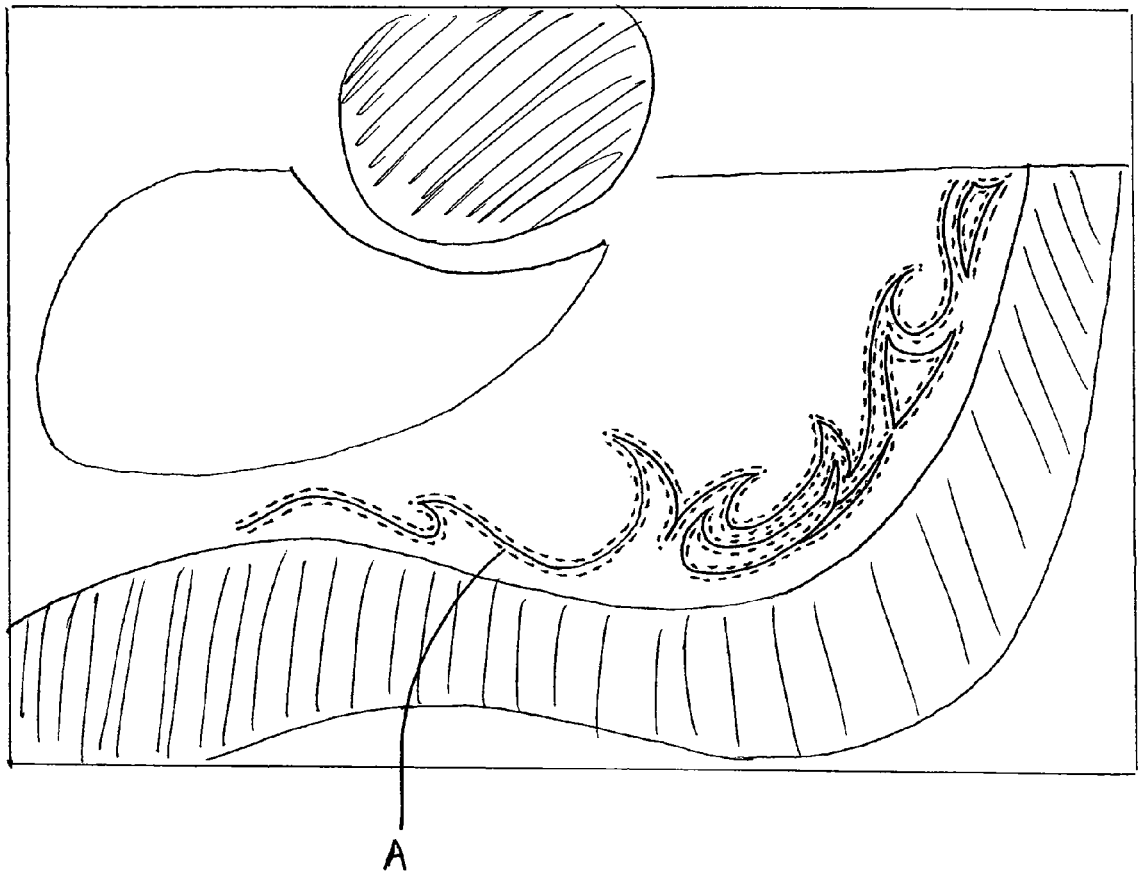
FIG. 5 shows an enlarged example of an artwork design on a guitar.

FIG. 4 shows an example of artwork A created on the wooden surface of a guitar. The dashed lines D show the continuation of the artwork, not shown in detail. FIG. 5 shows an enlargement of the artwork sample A. As discussed, some of the design work is created by pointed impressions from the template at spaced intervals so that they are discontinuous and some of the design appears as continuous or nearly continuous lines by spacing the needlepoint impressions very close together.

Once the design has been completely traced, the template is removed and the impressions are left in the surface. Preferably, to increase the contrast, color media such as stains or paints can be applied to the impressions which stain the impressions to increase the contrast of the impressed designs. However, staining or color media need not be employed and the design can be left without color or darkening material. Also, different portions of the design can be stained or painted different colors as desired.

If the surface on which the design is created is already a finished surface, one will appreciate that staining materials generally do not stain the surface except for where the impressions are formed by the needle tool. However, the invention is also applicable to unfinished, untreated wood. Typically, the impressed portions will stain or color more darkly than the surrounding, unfinished wood surface. For non-wood surfaces that are not penetrable by a stain, the coloring material will remain in the impressions when the staining or coloring material is wiped away from the surface, leaving the contrasting design.

The invention provides a unique way of creating customized and one of a kind artwork although it is also applicable to existing art designs or repetitive custom art on a plurality of different pieces.

Although the present invention has been described in relation to particular embodiments thereof, many other variations and modifications and other uses will become apparent to those skilled in the art. Therefore the present invention should be limited not by the specific disclosure herein, but only by the appended claims.

What is claimed is:

1. A method for creating a design on a surface, comprising:

providing a template to overlay the surface upon which the design is to be created;

forming a pattern of the design on the template for the design which is to be created on the surface;

placing the template with the pattern of the design thereon on the surface;

with a tool, tracing the pattern of the design on the template to form an impression on the surface below the template; and removing the template leaving the impression of the design on the surface, further wherein the step of tracing the pattern of the design on the template comprises using a needle-like pointed tool to form a series of discrete point impressions along the pattern of the design on the template to form the impression of the design on the surface as a series of discrete point impressions on the surface, further comprising staining the impression of the design on the surface to increase the contrast of the design.

2. A method for creating a design on a surface, comprising:

providing a template to overlay the surface upon which the design is to be Created;

forming a pattern of the design on the template for the design which is to be created on the surface;

placing the template with the pattern of the design thereon on the surface;

with a tool, tracing the pattern of the design on the template to form an impression on the surface below the template; and removing the template leaving the impression of the design on the surface, further wherein the step of tracing the pattern of the design on the template comprises using a needle-like pointed tool to form a series of discrete point impressions along the pattern of the design on the template to form the impression of the design on the surface as a series of discrete point impressions on the surface, further comprising staining the impression of the design on the surface to increase the contrast of the design, wherein at least some of the series of discrete point impressions are closely spaced so that they appear to be essentially a continuous or solid design.

3. The method of claim 2, wherein at least some of the series of discrete point impressions are spaced apart in the design on the surface.

4. The method of claim 2, further comprising staining portions of the design on the surface with different colors.

5. The method of claim 2, wherein the template comprises vellum.

6. The method of claim 2, wherein the pattern of the design on the template is drawn on the template using pencil, marker, ink or paint.

7. The method of claim 2, wherein the template is temporarily placed on the surface and held to the surface with tape.

8. The method of claim 2, wherein the surface is wood.

9. The method of claim 8, wherein the wood surface is a surface of a musical instrument.

10. The method of claim 9, wherein the musical instrument is a guitar.

11. The method of claim 2, wherein the step of staining the impression comprises applying a stain or paint.

12. The method of claim 2, wherein the tool perforates the template.

* * * * *